US008077101B1

(12) United States Patent
Mastarone, Jr. et al.

(10) Patent No.: US 8,077,101 B1
(45) Date of Patent: Dec. 13, 2011

(54) TRANS-GRADE COMMUNICATION NETWORK

(75) Inventors: John F. Mastarone, Jr., Arlington, VA (US); William J. Chappell, Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 1190 days.

(21) Appl. No.: 11/672,282

(22) Filed: Feb. 7, 2007

Related U.S. Application Data

(60) Provisional application No. 60/771,176, filed on Feb. 7, 2006.

(51) Int. Cl.
*H01Q 1/04* (2006.01)

(52) U.S. Cl. ..... 343/719; 343/767; 343/770

(58) Field of Classification Search ..... 343/767, 343/769, 770, 713, 711, 712, 719
See application file for complete search history.

(56) References Cited

U.S. PATENT DOCUMENTS 5,124,714 A * 6/1992 Harada ..... 343/713
5,621,419 A 4/1997 Meek et al.
6,307,519 B1 * 10/2001 Livingston et al. ..... 343/767
6,373,442 B1 * 4/2002 Thomas et al. ..... 343/767
7,088,301 B2 8/2006 Louzir et al.
7,106,262 B2 * 9/2006 Baranski ..... 343/713
7,129,900 B2 * 10/2006 De Angelis ..... 343/719
7,161,548 B2 * 1/2007 Tsukamoto ..... 343/767
7,196,673 B2 * 3/2007 Savage et al. ..... 343/719
2006/0176231 A1 * 8/2006 Pecora et al. ..... 343/795
2010/0253538 A1 * 10/2010 Smith ..... 340/870.02

* cited by examiner

*Primary Examiner* — Tho G Phan
(74) *Attorney, Agent, or Firm* — William F. Bahret

(57) ABSTRACT

Methods and apparatus that provide grade-level RF transceivers for use in trans-grade wireless communication networks. The methods involve incorporating slot antennas into grade-level opening covers, such as manhole covers, to provide built-in antennas for transceivers that may be connected by transmission lines. The grade-level transceivers use coupling mechanisms to connect transceivers to the slot antennas by way of transmission feed lines. Multi-slot grade-level transceivers use switching mechanisms to switch between multiple slot antennas. Certain embodiments may also include adaptable RF circuitry. Trans-grade wireless communication networks use these grade-level transceivers to communicate between below-ground and above-ground portions of the network, which may be used in underground utility systems such as combined sewer systems.

22 Claims, 6 Drawing Sheets

TRANS-GRADE COMMUNICATION NETWORK

CROSS-REFERENCE TO RELATED APPLICATION

This application claims the benefit of U.S. Provisional Patent Application Ser. No. 60/771,176, filed Feb. 7, 2006.

GOVERNMENT RIGHTS

This invention was made with government support under Contract/Grant No. 0330016 awarded by the National Science Foundation. The government has certain rights in the invention.

TECHNICAL FIELD OF THE INVENTION

The present invention relates generally to wireless communication networks and, more particularly, to methods and apparatus that provide trans-grade communication networks for underground utilities.

BACKGROUND OF THE INVENTION

Combined sewer systems are drain systems in which storm water and sanitary sewage are delivered to wastewater treatment plants in the same tunnel infrastructure. When rainwater or melted snow/ice enters these systems, the amount of sewage and storm water entering a treatment plant may exceed its capacity, resulting in a combined sewer overflow (CSO) that delivers excess untreated sewage and storm water to a local surface water body, such as a river or lake. Over seven hundred communities across the United States have combined sewer systems, and are affected by these overflows, which can be major sources of water pollution. Yearly national expenditures to combat CSOs are estimated to total several hundred million dollars.

One method of reducing CSOs is to perform flow monitoring and real-time control of inline storage. In this method, sensors detect increased water flow, and control valves hold sewage and storm water in place while the wastewater treatment plant processes sewage without exceeding capacity. A new technique to implement this type of control is to use a wireless sensor network. Wireless sensor nodes embedded in manhole tunnels can detect water flow and broadcast sensor data to a base station that can reply with instructions to close flow valves in the sewer system, which are also controlled by the sensor nodes. The wireless sensor network may have multiple hops from an embedded sensor node to the base station.

The task of establishing a radio frequency (RF) network connection between below-ground nodes and above-ground nodes is often difficult because manholes are often located in roadways where vehicles and snow plows run over and scrape the manhole entrances. Therefore radio antennas used to make the connection may be destroyed if they have profiles that extend above road grade level.

SUMMARY OF THE INVENTION

One aspect of the present invention involves methods of incorporating slot antennas into grade-level opening covers to provide environmentally-robust RF antennas that may be used to make wireless connections between below-ground and above-ground portions of a trans-grade wireless communications network. One of these methods involves cutting a slot into the cover for use as an antenna (where the cover itself is the ground plane) and adding a coupling mechanism for connecting a transmission feed line. Another of these methods involves retrofitting a previously existing slot within a cover to act as a slot antenna by adding a coupling mechanism for connecting a transmission feed line thereto.

Another aspect of the present invention pertains to wireless trans-grade communication networks that may be used to establish wireless communications between below-ground and above-ground portions of underground utility systems. The networks generally include a below-grade communication device, an above-grade communication device, and a grade-level RF transceiver.

One embodiment of the grade-level RF transceiver generally includes a manhole cover with a slot antenna incorporated therein, and a transceiver that uses the slot antenna to transmit and receive information between below-ground and above-ground portions of the network. Another embodiment of the grade-level RF transceiver involves a multi-slot grade-level RF transceiver that includes a grade-level cover with multiple slot antennas therein, a switching mechanism for switching between the antennas, and a transceiver. Certain embodiments of the grade-level RF transceiver may also include adaptable RF circuitry, such as a two-stage impedance tuner, or other matching network.

The objects and advantages of the present invention will be more apparent upon reading the following detailed description in conjunction with the accompanying drawings.

DESCRIPTION OF PREFERRED EMBODIMENTS

Figure 1:
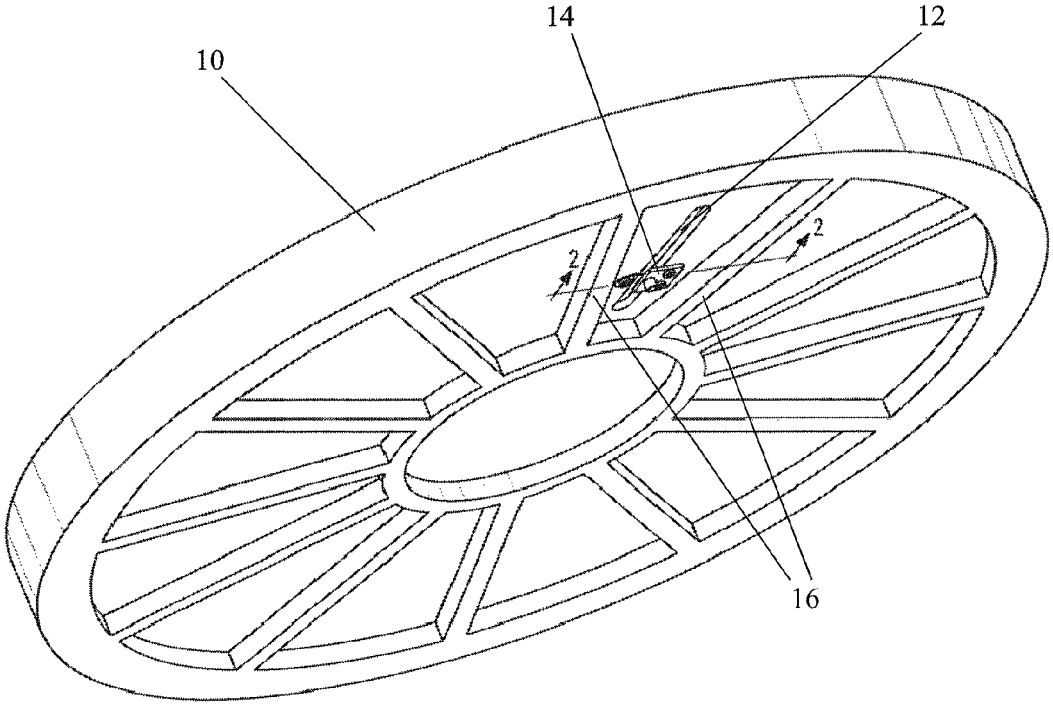
FIG. 1 is a perspective view of a grade-level cover with built-in slot antenna according to one aspect of the present invention.

For the purpose of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device and such further applications of the principles of the invention as illustrated therein being contemplated as would normally occur to one skilled in the art to which the invention relates.

One aspect of the present invention involves methods of incorporating slot antennas into grade-level opening covers, such as storm drain grates and manhole covers that cover surface-level openings of underground tunnels, to provide environmentally-robust RF antennas (radiators, waveguides) that may be used to make wireless connections between below-ground nodes and above-ground nodes in underground utility monitoring networks. The size, shape, positioning, and manner of incorporating slot antennas into grade-level covers may vary depending upon the particular application. For example, the length of the slot will vary depending upon the radio frequency used in the network, and the positioning of the slot will vary depending upon the particular construction of the cover. Fabrication processes used to make a grade-level cover with a built-in antenna may also vary depending upon its design and construction.

Figure 2:
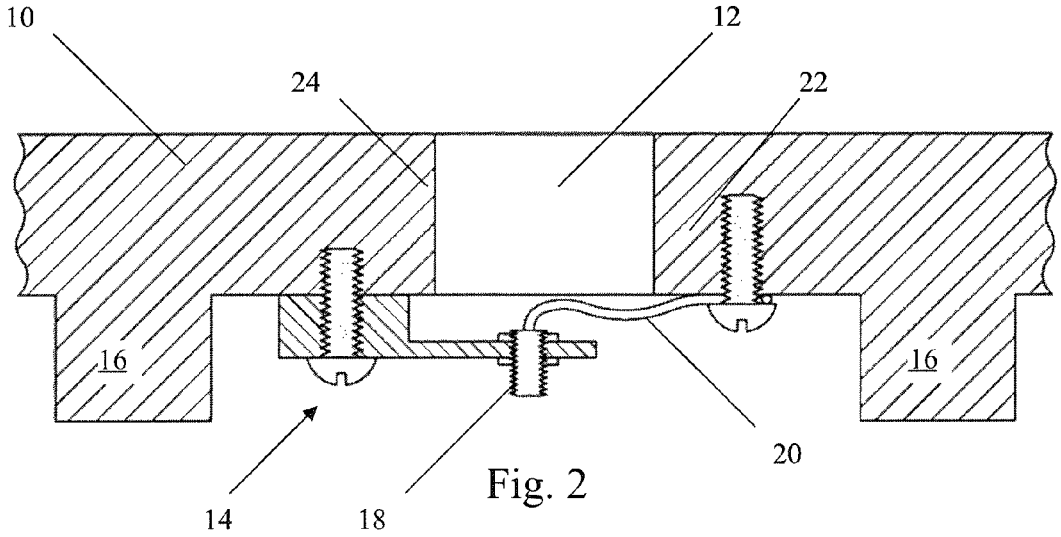
FIG. 2 is a horizontal cross-section of the cover of FIG. 1.

One of these methods of incorporating a slot antenna into a grade-level cover involves cutting a slot into the cover for use as an antenna (where the cover itself is the ground plane) and adding a coupling mechanism for connecting a transmission feed line. FIGS. 1 and 2 show, as an example, a solid cast-iron manhole cover 10 with a slot antenna 12 incorporated therein.

The antenna shown is a half-wavelength slot antenna with transmission line coupler 14 that is designed for use in a 916 MHz frequency wireless network which uses SMA (SubMiniature version A) transmission line connectors (coaxial RF connectors). The 6.8 inch long slot is drilled completely through the z-axis of the cover, using a 5/16 inch diameter drill bit on a conventional milling machine, and is positioned between two arbitrarily chosen ridges 16 to reduce near-field interaction, prevent structural weakening of the cover, and keep fabrication time to a minimum. The 5/16 inch slot width was selected in this particular application to facilitate machining and to accommodate the particular coupling mechanism used to connect the transmission feed line.

The transmission line coupler 14 shown in FIG. 2 is a ½ inch wide piece of brass with a modified female SMA connector 18, but other types of transmission line connectors may also be used in the coupling mechanism, such as BNC-type connectors, for example. The center conductor 20 of the female connector is connected to the side of the slot (22) opposite the coupler, while the outer conductor is connected through the coupler to the coupler-side of the slot 24, forcing magnetic field coupling in the slot when a signal is applied through the coaxial connector. Coupler 14 is positioned as an off-center feed, but the coupler may be otherwise positioned, depending upon the particular application.

Figure 3:
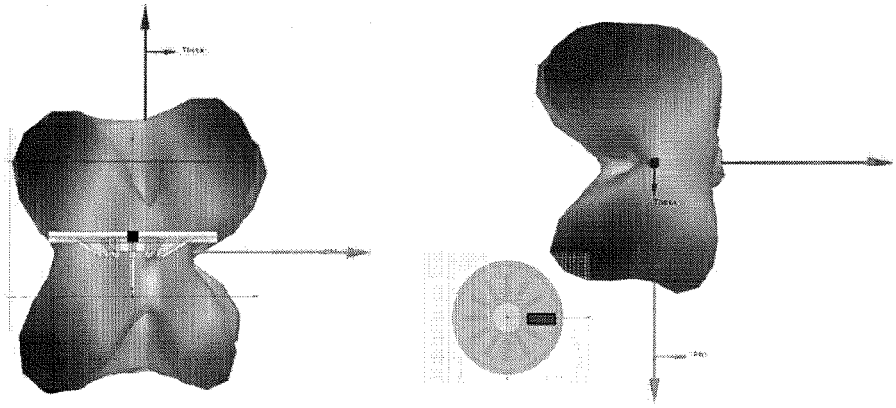
FIG. 3 shows a simulated radiation pattern using the cover of FIG. 1.

Simulations showed that an exact $\lambda/2$ slot radiator (at 916 MHz) in the manhole cover of FIG. 1 has a resonant frequency of approximately 945 MHz, due to surface features of the cover and loading from the coupling mechanism. The simulated radiation pattern of the 916 MHz antenna of FIG. 1 (with respect to different orientations of the manhole cover) is shown in FIG. 3.

Another method of incorporating a slot antenna into a grade-level cover involves retrofitting a previously existing slot within a cover to act as a slot antenna by adding a coupling mechanism for connecting a transmission feed line thereto. This method may be employed, for example, in a sewer system that has been previously fitted with multiple, substantially uniform manhole covers, where each cover has one or more slots therein or therethrough. If the wireless network in this example is designed to use previously existing slots, the cost and labor of creating slots for use as slot antennas within the network would be avoided. The operating frequency used in the network may then be selected to be close to, or the same as the resonant frequency of one or more of the slots that are common among the slotted manhole covers.

Another aspect of the present invention pertains to wireless trans-grade communication networks that may be used to establish wireless communications between below-ground and above-ground portions of underground utility systems. Networks according to this aspect of the present invention may be used in different types of underground utility systems, such as in power transmission or natural gas distribution systems, for example, and may be applied in different ways, such as strictly a sensing network, or as part of a system's control network.

Figure 4:
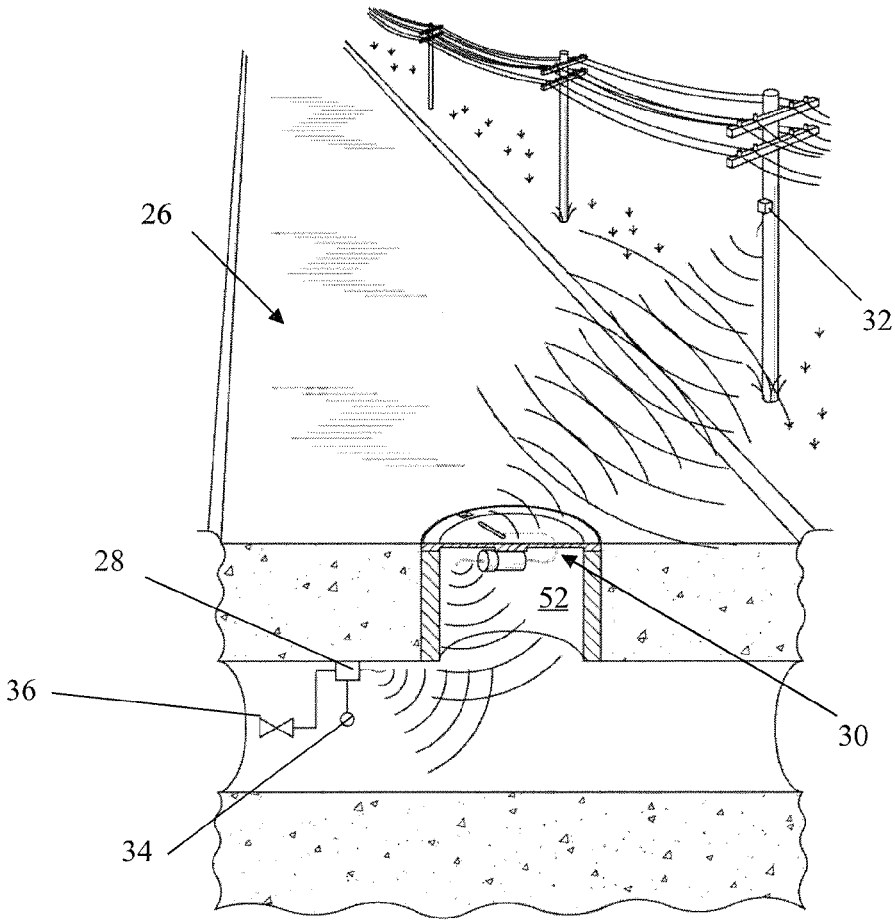
FIG. 4 shows a portion of a wireless trans-grade communication network according to another aspect of the present invention.

One application of such a wireless trans-grade communication network is a flow monitoring network used to reduce CSOs in a combined sewer system as previously described. FIG. 4 shows a portion of such a flow monitoring network 26 that generally includes one or more below-ground nodes 28, a grade-level transceiver 30, and one or more above-ground nodes 32.

A broad variety of devices may be used as nodes in the trans-grade communication network depending upon the particular network application. The below-ground nodes used in the flow monitoring network of FIG. 4 generally include a transceiver (such as a Chipcon CC1000 from Texas Instruments), a microcontroller (such as an ATmega128L from Atmel Corporation of San Jose, Calif.), one or more sensors 34 (such as a pressure sensor or flow meter), and a power supply. Devices such as the MICA2, Imote2, TelosB, and MICAz series wireless sensors from Crossbow Technologies, Inc. of San Jose, Calif. may also be used. The above-ground nodes are generally similar to the below-ground nodes, but typically do not include sensors. The below-ground node shown is connected to a smart valve 36 that helps to control inline storage in the combined sewer system.

The grade-level transceiver 30 (FIGS. 5 and 6) generally includes a manhole cover 38 with a slot antenna 40 incorporated therein (as detailed above), and a transceiver, housed in a water-tight housing 42, which uses the slot antenna to transmit and receive information between below-ground and above-ground nodes.

Figure 6:
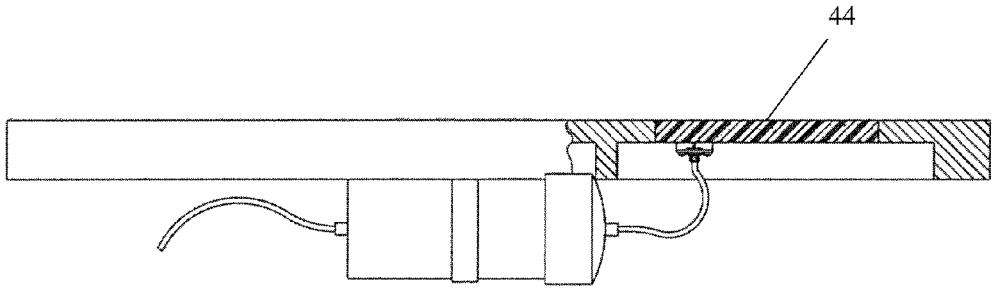
FIG. 6 shows a partial cross-section of the transceiver of FIG. 5.

The slot antenna of the grade-level transceiver may be filled with a low dielectric constant material 44, as shown in FIG. 6, such as polystyrene or silicone, for example, to make the apparatus more robust. The size of the slot may also be modified from an exact $\lambda/2$ slot radiator based upon the particular characteristics of the grade-level cover used in the apparatus. As described above, simulations showed that the slot antenna of FIG. 1 actually had a resonant frequency of 945 MHz. Therefore the slot may be made slightly longer to achieve the desired resonant frequency of 916 MHz.

Figure 5:
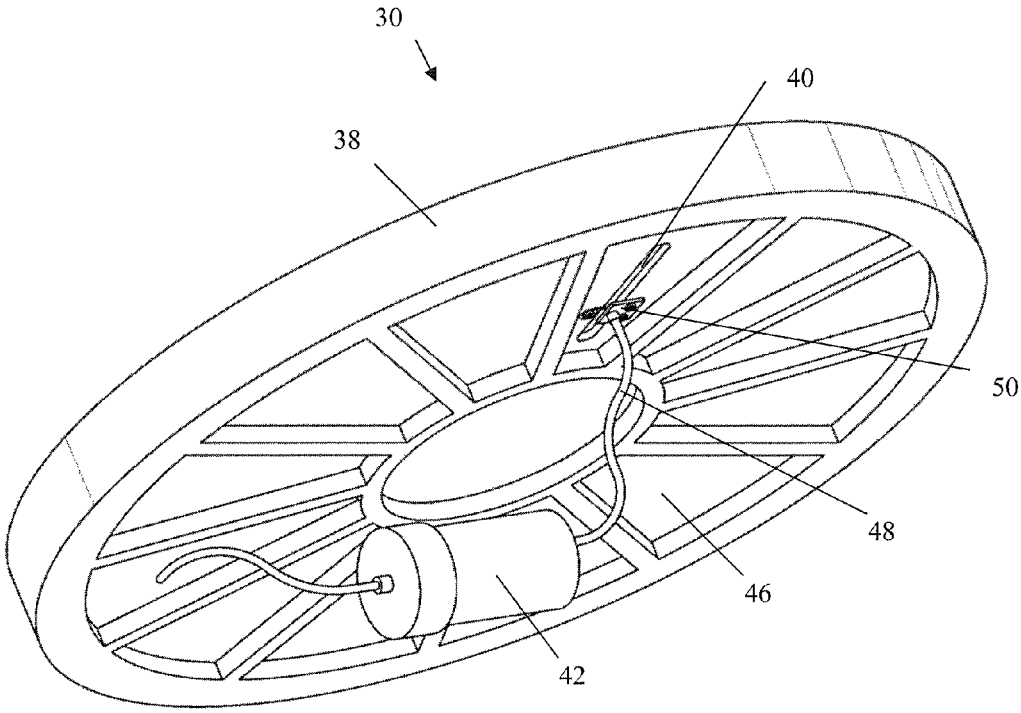
FIG. 5 shows an embodiment of a grade-level transceiver used in the network of FIG. 4.

The transceiver of the grade-level transceiver is preferably physically connected directly to the bottom side 46 of the manhole cover by way of the water-tight housing, as shown in the example of FIG. 5, using a short coaxial cable 48 connected to the line coupler 50 so as to provide a complete, relatively compact unit. In certain applications, however, where the architecture of the wireless network requires it, the transceiver may be remotely located within a manhole tunnel, for example, and connected to the line coupler by an extensive coaxial cable. A broad variety of transceivers may be used, depending upon the requirements of the wireless network. Transceivers used in the flow monitoring network of FIG. 4 include XStream series and XTend series transceivers from MaxStream, Inc. of Lindon, Utah.

Figure 7:
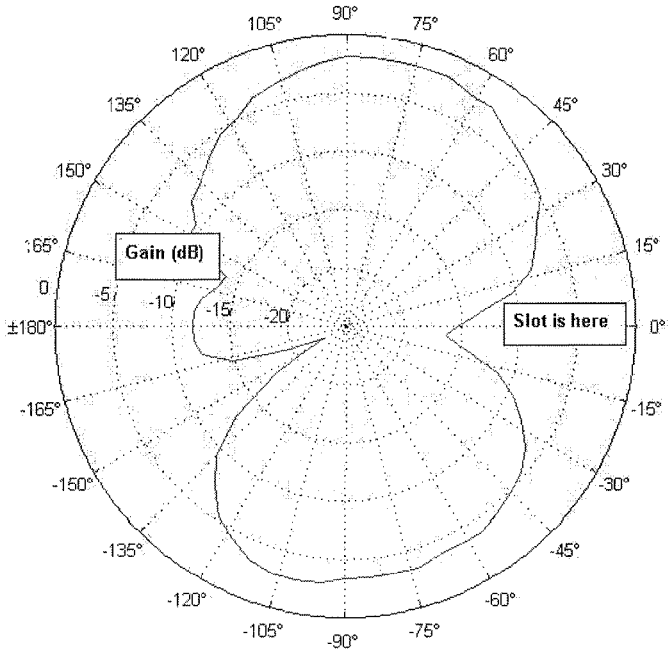
FIG. 7 shows measured gain of the transceiver of FIG. 5.

In operation, the grade-level transceiver will be placed over a manhole tunnel opening 52 of a sewer (FIG. 4), or other underground utility network, and will produce a semi-directional radiation pattern due to the orientation of the slot antenna in the manhole cover. The grade-level transceiver of FIG. 5 was placed over a test manhole tunnel opening, and the antenna's gain, shown in FIG. 7, was measured at 30 degrees above grade level, 5 feet away and 35 inches above grade-level. The figure shows that the grade-level transceiver's radiation pattern has nulls parallel to the slot in the manhole cover. Therefore, the slot antenna of the grade-level transceiver may have to be perpendicularly aligned with a nearby above-ground node (FIG. 4) so that it will be more likely to establish a wireless link therewith. It may be desirable in certain situations to avoid the necessity of relying upon the alignment of the slot. One way to eliminate the need is to use antenna diversity, detailed below.

Figure 8:
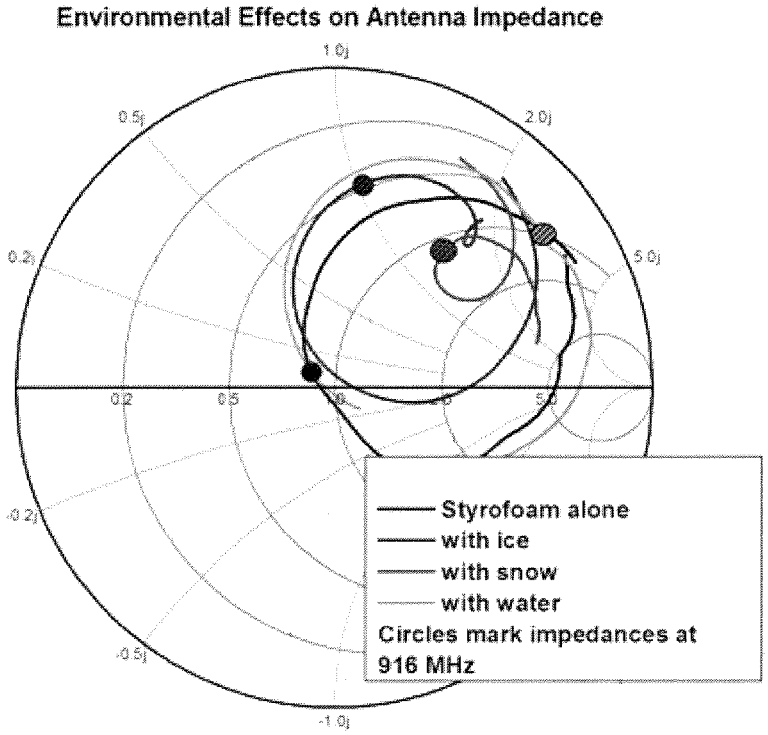
FIG. 8 shows environmental effects on impedance of the antenna of the transceiver of FIG. 5.

Operation of the grade-level transceiver may be impacted by the harsh environment in which it is situated. In particular, it may be exposed to rain, snow, and ice that might collect upon the grade-level cover and affect the properties of the slot antenna. FIG. 8 shows measured changes in antenna impedance due to forms of water covering a Styrofoam-filled slot antenna of a grade-level transceiver. As shown in the figure, the general effect of forms of water on the antenna is to shift the resistance to values between 20 and 100 ohms (near 916 MHz), and to add a reactance of between j50 and j150 ohms.

Figure 9:
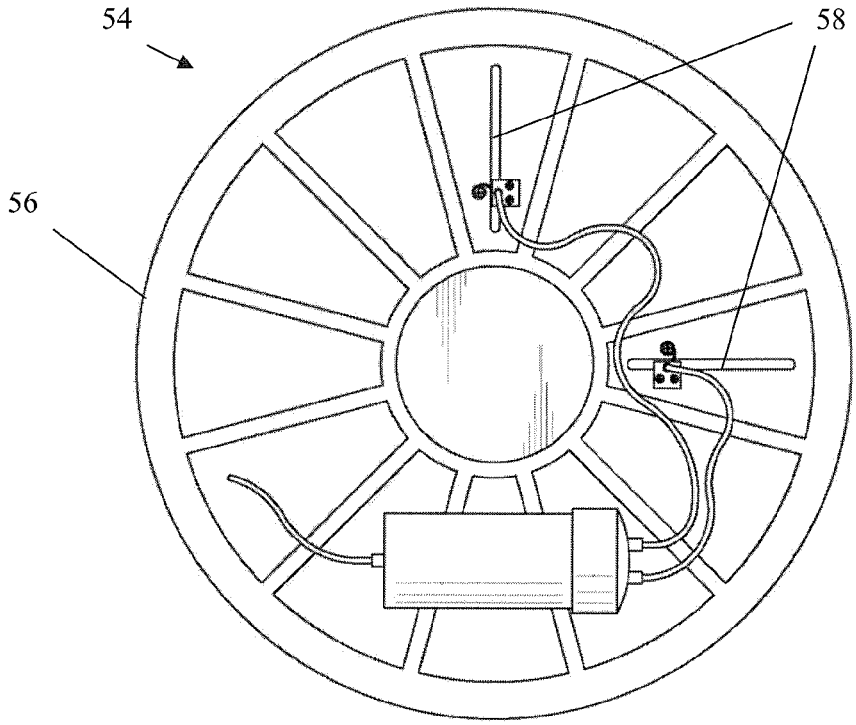
FIG. 9 shows an embodiment of a multi-slot grade-level transceiver according to the present invention.

Accordingly, another aspect of the present invention involves a multi-slot grade-level transceiver that uses antenna diversity to improve the likelihood of successfully establishing a wireless link between the two parts of the wireless network. The multi-slot transceiver generally includes a grade-level cover with multiple slot antennas therein, a switching mechanism for switching between the antennas, and a transceiver with microcontroller (such as the MICA2 series motes mentioned above). FIG. 9 shows one such example 54, where the grade-level cover 56 is a manhole cover.

Figure 10:
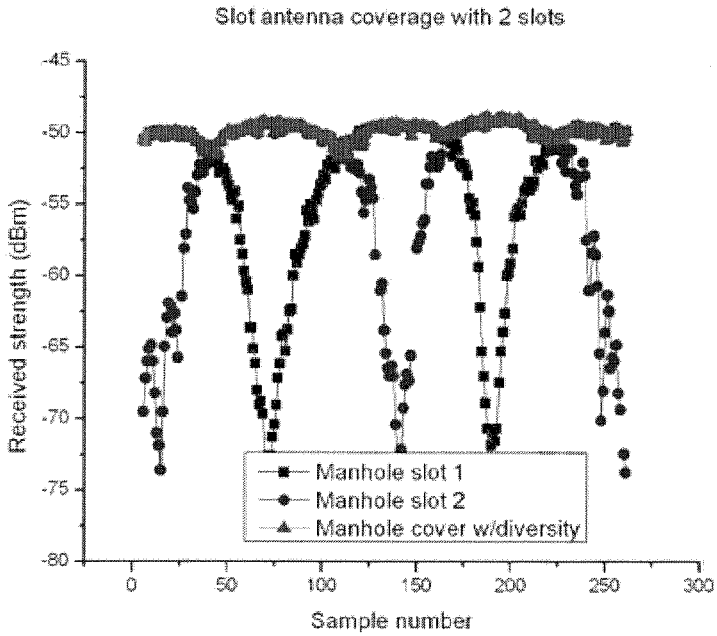
FIG. 10. shows individual and combined signal strength values received from the antennas of the multi-slot transceiver of FIG. 9.

The slot antennas 58 are preferably substantially orthogonally positioned, as shown in FIG. 9, to provide a combined radiation pattern with improved gain levels in all directions, but the antennas may be positioned in other relationships depending upon the particular application. The signal transmission strength of the multi-slot transceiver of FIG. 9 was tested by moving a receiver in a circular path about the cover while placed over a test manhole tunnel opening. FIG. 10 shows that nearly constant signal transmission strength measurements were achieved using two substantially orthogonally positioned antennas.

The microcontroller uses the switching mechanism to establish the best wireless RF link possible with the above-ground nodes. One example of such a switching mechanism is a circuit that utilizes a single-pole double-throw (SPDT) RF switch (such as a PE4220 from Peregrine Semiconductor Corporation of San Diego, Calif.) to switch between the two antennas and allow the microcontroller to determine which of the antennas attain the best link. The switching mechanism may also include adaptable RF circuitry, in certain applications, to change the impedance characteristics of one or more of the slot antennas.

Figure 11:
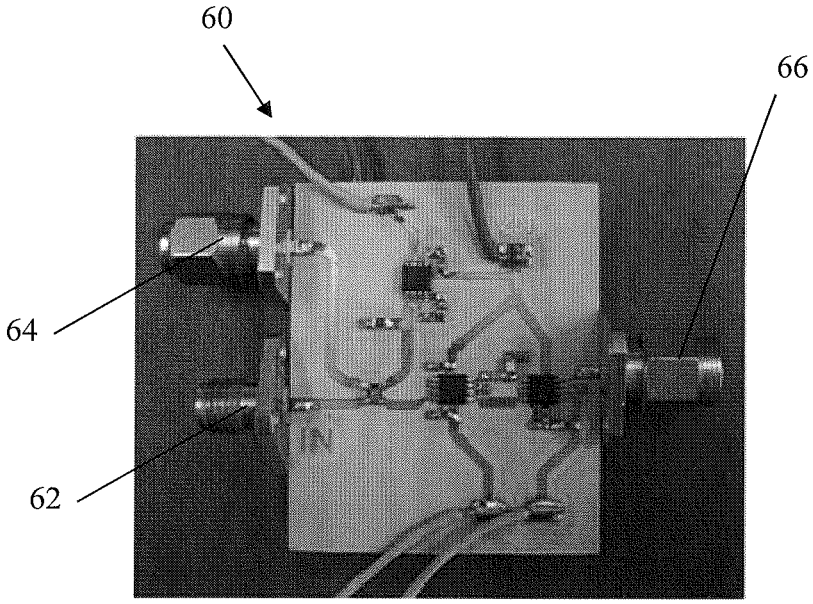
FIG. 11 shows a switching mechanism with adaptable RF circuitry used in the grade-level transceiver of FIG. 9.
Figure 12:
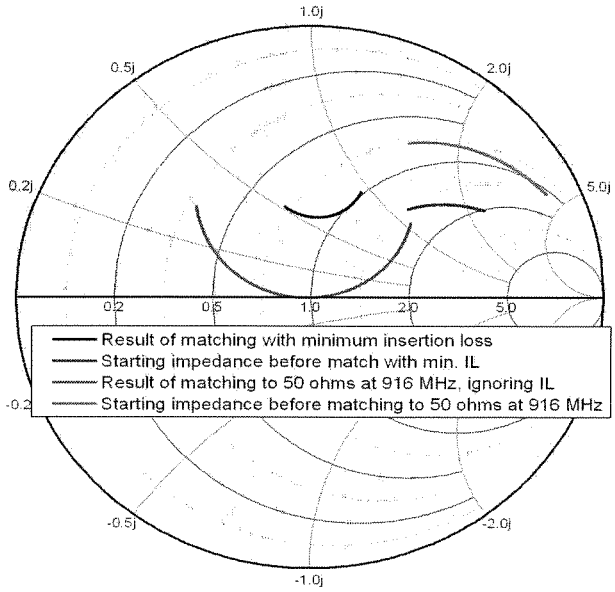
FIG. 12 shows results of the LC matching circuit's effect on impedance of the slot antennas of the multi-slot transceiver of FIG. 9.

An example of a switching mechanism with adaptable RF circuitry is shown in FIG. 11, in the form of a two-stage impedance tuner 60 designed for use with the two-slot grade-level transceiver shown in FIG. 9, but other more complex matching solutions may also be used, such as low insertion-loss wide-range matching networks. The two-stage impedance tuner shown has an input coaxial connector 62 for connecting the transceiver and two coaxial connection ports (64, 66) for connecting the two antennas. The adaptable RF circuitry utilizes a SPDT switch to switch between a 50-ohm thru-line and a 3.9 nH-3.9 pF LC matching network, both of which are connected to each of the antennas. In certain applications, a separate thru-line and matching network, with an associated SPDT selection switch, may be provided for each slot antenna. FIG. 12 shows results of the LC matching circuit's effect on impedance of the slot antennas.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A manhole cover with built-in RF antenna and feed,
wherein said built-in RF antenna comprises a slot through said manhole cover, and
wherein said built-in RF antenna feed comprises a transmission line connector having first and second conductors connected to first and second sides of said slot, respectively.

2. The manhole cover of claim 1, wherein said slot is filled with a low dielectric constant material.

3. The manhole cover of claim 1, wherein said transmission line connector is a coaxial connector disposed within the vertical space defined by said slot.

4. A method of incorporating an RF antenna into a grade-level opening cover, comprising:
creating a slot in the grade-level opening cover to radiate at a predetermined radio frequency;
connecting one line of a transmission line to a first side of said slot; and
connecting another line of said transmission line to a second side of said slot.

5. The method of claim 4, further comprising:
providing a transmission line connector;
connecting said transmission line connector adjacent said slot; and
connecting said transmission line to said slot through said transmission line connector.

6. A grade-level cover RF transceiver, comprising:
a grade-level cover having a first slot therethrough, said slot sized and shaped to radiate at a predetermined radio frequency;
a first cable having first and second conductors connected to first and second sides of said slot, respectively; and
an RF transceiver connected to said first cable.

7. A grade-level cover RF transceiver, comprising:
a grade-level cover having a first slot therethrough, said slot sized and shaped to radiate at a predetermined radio frequency;
a first cable having first and second conductors connected to first and second sides of said slot, respectively;
an RF transceiver connected to said first cable;
a second slot through said grade-level cover said second slot having the same size and shape as said first slot;
a second cable having first and second conductors connected to first and second sides of said second slot, respectively; and
an RF switch connected to said first and second cables and controlled by said RF transceiver for switching between said slots.

8. The grade-level cover RF transceiver of claim 7, wherein said RF switch includes an impedance matching network.

9. The grade-level cover RF transceiver of claim 8, wherein said impedance matching network comprises a two-stage impedance tuner.

10. The grade-level cover RF transceiver of claim 8, wherein said first and second slots are rectangular and said second slot is substantially orthogonally positioned with respect to said first slot.

11. The grade-level cover RF transceiver of claim 10, wherein said grade-level cover comprises a manhole cover.

12. The grade-level cover RF transceiver of claim 10, wherein said grade-level cover comprises a storm drain grate.

13. The grade-level cover RF transceiver of claim 7, further comprising a microcontroller configured to use said RF switch to establish the best RF link with an above-ground node.

14. A trans-grade communication network, comprising:

a below-grade communication device;

an above-grade communication device; and a grade-level cover incorporating first and second antennas and associated feeds for RF communications between said below-grade communication device and said above-grade communications device, said first and second antennas having slots of the same size and shape; and an RF transceiver connected to said first and second antennas and configured for antenna selection.

15. The trans-grade communication network of claim 14, wherein said below-grade communication device comprises an environmental sensor.

16. The trans-grade communication network of claim 14, further comprising an impedance matching network for adjusting the impedance of said first antenna.

17. The trans-grade communication network of claim 14, wherein said first and second antennas each comprise a slot through said grade-level cover.

18. The trans-grade communication network of claim 14, further comprising an RF switch connected to said first and second antennas.

19. The trans-grade communication network of claim 14, further comprising a microcontroller configured to use said RF switch to establish the best RF link with an above-ground node.

20. A method of incorporating an RF antenna into a grade-level opening cover, comprising:

creating a slot in the grade-level opening cover to radiate at a predetermined radio frequency;

connecting one line of a transmission line to a first side of said slot; and connecting another line of said transmission line to a second side of said slot;

wherein said slot has sidewalls and end walls defining a vertical space extending through and below said cover, said method further comprising:

mounting a coaxial connector on the underside of said cover with an inner conductor and outer conductor of said coaxial connector positioned within said vertical space;

mechanically supporting said coaxial connector within said vertical space with a metallic coupler mechanically and electrically connected to said outer conductor and to the first side of said slot; and electrically connecting said inner conductor to the second side of said slot.

21. A grade-level cover RF transceiver, comprising:

a grade-level cover having a first rectangular slot therethrough, said slot sized and shaped to radiate at a predetermined radio frequency;

a first cable having first and second conductors connected to first and second sides of said slot, respectively;

an RF transceiver connected to said first cable;

a second rectangular slot through said grade-level cover, substantially orthogonal to said first slot, and sized and shaped to radiate at a predetermined radio frequency;

a second cable having first and second conductors connected to first and second sides of said second slot, respectively; and an RF switch connected to said first and second cables and controlled by said RF transceiver for switching between said slots, said RF switch including an impedance matching network having a two-stage impedance tuner.

22. The grade-level cover RF transceiver of claim 21, further comprising a microcontroller configured to use said RF switch to establish the best RF link with an above-ground node.

* * * * *